US005192219A

United States Patent [19]

Fowler et al.

[11] Patent Number: 5,192,219

[45] Date of Patent: Mar. 9, 1993

[54] VIBRATION RESISTANT LOCKING COUPLING

[75] Inventors: Clifford C. Fowler, Chatsworth; Edward P. Goett, Geyserville, both of Calif.

[73] Assignee: Engineered Transitions Co., Inc., Healdsburg, Calif.

[21] Appl. No.: 761,303

[22] Filed: Sep. 17, 1991

[51] Int. Cl.[5] ..... H01R 4/38

[52] U.S. Cl. ..... 439/321; 439/350

[58] Field of Search ..... 439/307, 310, 311, 318, 439/320–323, 180, 352, 350

[56] References Cited

U.S. PATENT DOCUMENTS 3,465,092 9/1969 Schwartz ..... 439/320
4,017,139 4/1977 Nelson ..... 439/352
4,154,496 5/1979 Gallagher ..... 439/321
4,597,620 7/1986 Lindner et al. ..... 439/320
4,941,846 7/1990 Guimond et al. ..... 439/180

*Primary Examiner*—Larry I. Schwartz
*Assistant Examiner*—Hien D. Vu
*Attorney, Agent, or Firm*—Howard L. Rose

[57] ABSTRACT

The invention provides a locking coupling having a hollow cylindrical body with a circumferential ring of axially extending radial teeth, a first coaxial collar having a plurality of spring fingers extending axially therefrom with inwardly directed, axially extending teeth overlying the teeth on said body and a coaxial locking collar slidably mounted on said body between two positions and having a region overlying the spring fingers, the locking collar forcing the teeth on the spring fingers into engagement with the teeth on the body in one position and permitting the teeth to become disengaged in the other position.

15 Claims, 6 Drawing Sheets

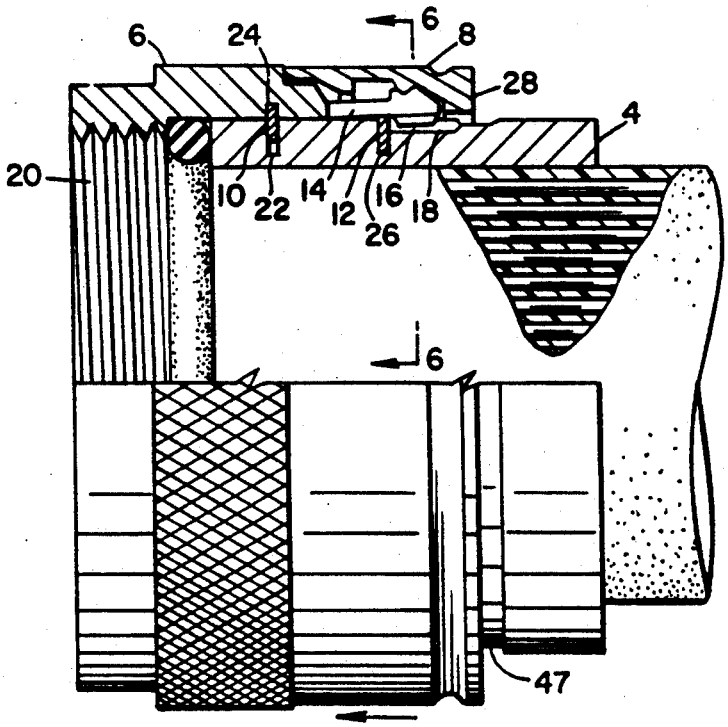
Fig. 5
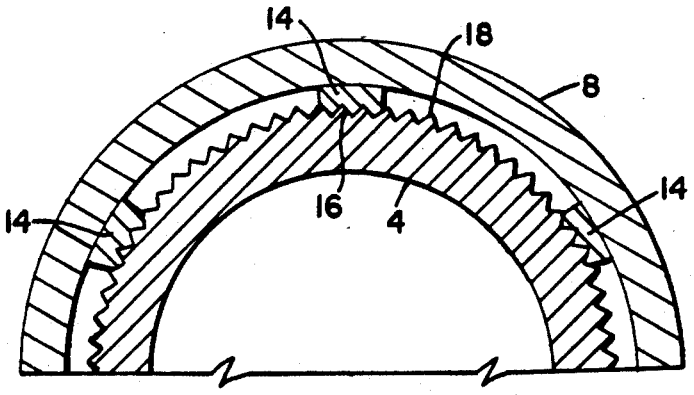
Fig. 6
Fig. 7
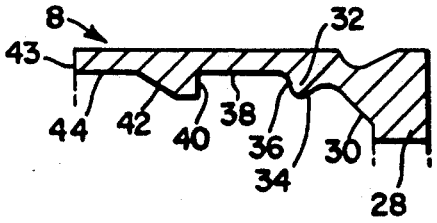
Fig. 8
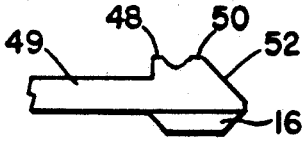

VIBRATION RESISTANT LOCKING COUPLING

FIELD OF INVENTION

The present invention relates to vibration resistant locking couplings and more particularly to mechanical spin couplings having utility as, amongst others, backshell adapters for multipin electrical connectors.

BACKGROUND OF THE INVENTION

In U.S. Pat. No. 4,793,821 issued Dec. 27, 1988 to Fowler and Goett there is described a vibration resistant backshell adapter coupling that has found wide acceptance in the pertinent industry.

The present invention is provided to simplify the construction of the patented connection without loss of effectiveness. Further, it is essential that the adapter coupling does not increase the outer diameter of the overall structure as was emphasized in the above cited patent. As indicated therein the coupling of that device met for the first time, certain military specifications on the external diameter of backshell adapter couplings. The present invention must also and does meet this size requirement.

OBJECTS OF THE PRESENT INVENTION

It is an object of the present invention to provide a vibration resistant coupling, the locking force of which may be readily determined during the manufacturing process.

It is another object of the present invention to provide a vibration resistant coupling in which the force resisting rotation as a result of vibration may be made greater than the destruction force of the coupling and yet may readily provide decoupling so as to permit free rotation of the elements relative to one another.

It is still another object of the present invention to provide a vibration resistant coupling that may provide greater resistance to rotation resulting from vibration than the aforesaid patented device depending upon the use contemplated for the coupling.

It is yet another object of the present invention to provide a backshell coupling that when in the locked position cannot rotate and ca be rotated only be destroying the device, the required destruction torque being determined during manufacture.

Other objects of the present invention are to provide locking and unlocking of a coupling: 1) without the need for special tools, 2) an indicator of locked and unlocked status, 3) improved electrical conductive path, 4) ability to withstand large axial retention forces, and a coupling that spins freely in the unlocked condition.

It is still another object of the present invention to provide an embodiment of a locking coupling that once locked cannot be unlocked.

It is still another object of the present invention to provide a locking coupling providing a stronger positive lock than the prior art.

Yet another object of the present invention is to provide areas of the coupling on which instructions may be imprinted or embossed.

BRIEF DESCRIPTION OF THE PRESENT INVENTION

The present invention comprises a hollow cylindrical body having a circumferential ring of axially extending radial teeth, a first coaxial collar secured to said body and rotatable with respect thereto, the collar having a plurality of axially extending spring fingers from one end, said fingers having inwardly extending radial teeth overlying the ring of teeth of said cylindrical body and a second coaxial or locking collar slidably mounted on said body overlying said spring fingers, the locking collar having an internal configuration such that in one position it permits the teeth on the spring fingers to remain out of contact with the teeth on the body and in another position forces the teeth on the spring fingers into intimate contact with the teeth on the body whereby to resist rotation of the elements relative to one another, the force resisting rotation and decoupling being determined by the number of spring fingers on the first collar. The present mechanism is not a ratcheting device, it is strictly a locking device in which rotation of the collar when the device is in the locked condition can occur only by destruction of the device. The destruction force is determined by the number of spring fingers employed as is the force required to unlock the coupling. Once the spring fingers are locked against the teeth on the body the spacing between the locking member and the teeth on the body is radially substantially fully filled by the spring fingers the space being less than the depth of the tooth engagement. Thus, ratcheting cannot occur and rotation can occur only by applying to the collar on which the spring fingers are mounted sufficient force to destroy the fingers. The locking mechanism is axially slidable between locking and unlocking positions and is not affected by rotational forces but the number of fingers pressing outwardly against the locking collar determine the force required to move the collar.

It should be noted that once in the locking position the locking collar may or may not be rotatable about the joint collar. Also movement of the locking collar does not require special tools; sliding movement is all that is required. Also because of the use of sliding motion different areas of the device are uncovered at each of the locked and unlocked positions permitting instructions to be imprinted on these areas that are germaine to the particular position.

The end of the first collar remote from the spring fingers may be provided with a coupling mechanism which in the embodiment illustrated in the accompanying drawings is internally threaded. In such an arrangement the first collar may be threaded onto any externally threaded cylindrical member such as the rear or back of a multipin electrical connector. In such an application, the device of the present invention is referenced to a backshell adapter.

Where the device is employed as a backshell adapter, the coupler is slipped over the ends of the electrical wires of a cable prior to their connection to the multipin electrical connector. The wires are joined to the electrical connector and then the first collar is threaded onto the back of the electrical connector. The locking collar is then slid into the locking position and a positive lock is provided between the backshell adapter and the electrical connector. Positive lock, for the purposes of this patent, is defined as follows: when the coupling is in the locked position it is essentially a solid assembly. It cannot be disengaged from the mating connector without destroying the backshell adapter and/or the connector. In the unlocked condition it functions the same as a non-locking coupling. The fact that positive lock is provided, the coupler provides a far better electrical path than provided by prior art devices; the strong physical contact providing a good electrical path.

It is apparent that the coupler of the invention may be used in any situation where connection of the coupler to another structure requires free rotation of the first collar relative to its associated cylindrical body but subsequently requires that relative rotation or movement be made somewhat difficult or prevented entirely. Such an environment may be pneumatic and hydraulic hose fittings. As indicated above, this feature is achieved by locking down the spring fingers. Further, this operation is achieved without increasing the diameter of the locking coupling beyond prescribed limits set forth in military standards.

BRIEF DESCRIPTION OF THE DRAWINGS

FIG. 5 is a view in partial longitudinal section showing the coupling in the locked position;

FIG. 6 is a view in cross-section of the coupling in the locked position;

FIG. 7 is a view detailing one example of the internal configuration of the second collar of the device;

FIG. 8 is a view detailing one example of the contours of the outer surface of the spring fingers where they engage the contoured surface of the second collar;

DETAILED DESCRIPTION OF THE PRESENT INVENTION

Figure 1:
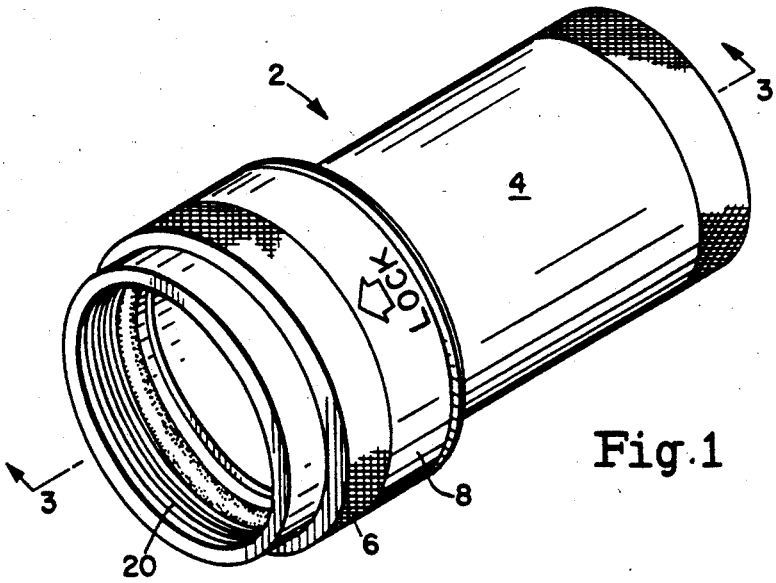
FIG. 1 is a perspective view of the assembled coupling.
Figure 2:
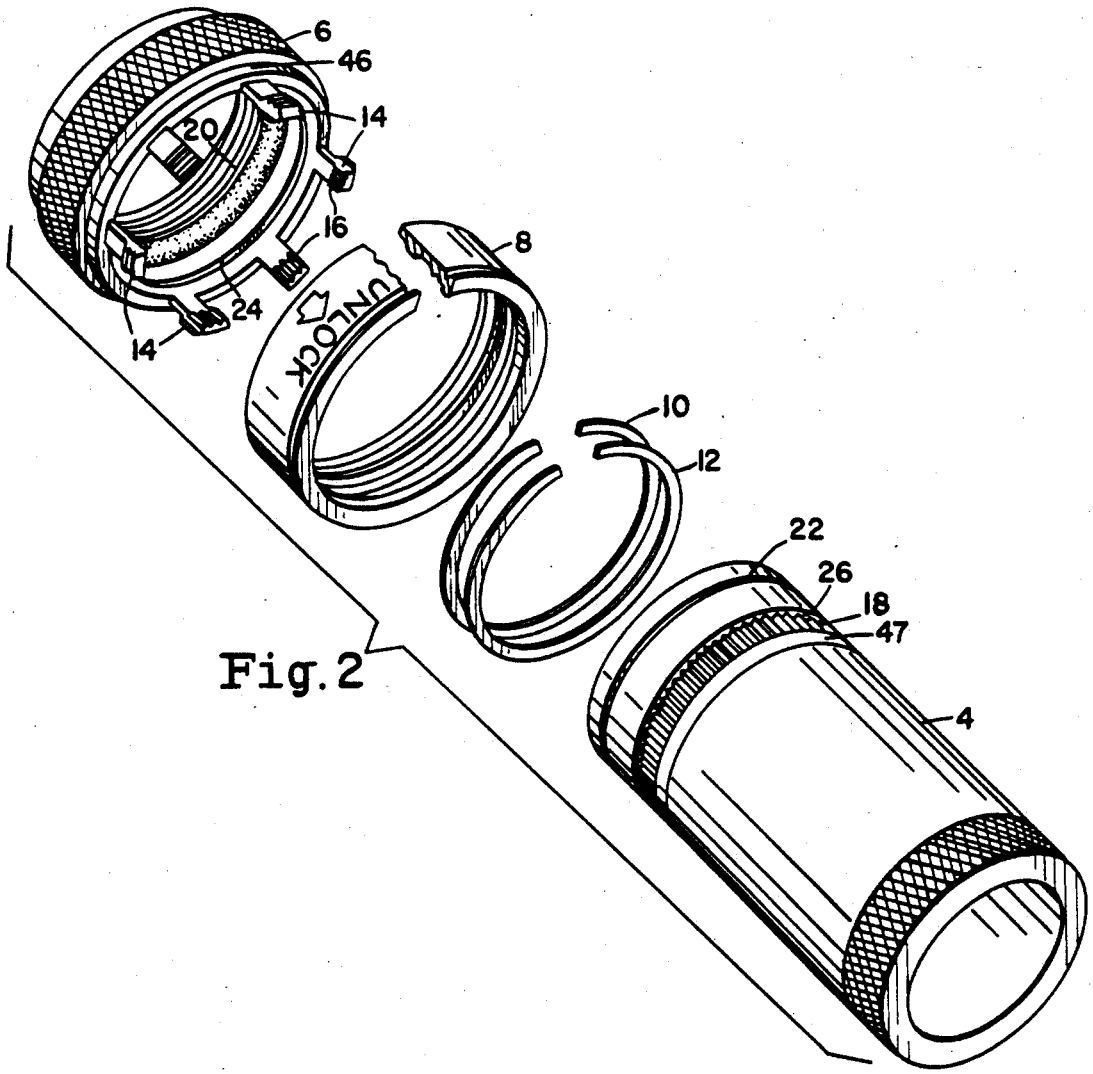
FIG. 2 is an exploded view of the disassembled coupling.

Referring specifically to FIGS. 1 and 2 of the accompanying drawings the backshell adapter, generally designated by reference numeral 2, comprises a hollow cylindrical body 4, a first collar 6, a locking collar 8 and spring rings 10 and 12, the ring 10 being a retainer ring and the ring 12 being a biasing ring as explained subsequently.

The first collar 6 has a plurality of axially extending fingers 14 having inwardly directed radial teeth 16. The fingers 14 may or may not be homogenous with the first collar 6 and the fingers may be made of another material having properties different from and attached to the first collar. The method of attachment can be made by, but not limited to, pinning, riveting, staking, keying, brazing or welding. The body 4 has a circumferentially extending band of radially extending axially aligned teeth 18 matching the teeth 16 of the fingers 14. The locking collar 8 has an internal configuration which cooperates with an external configuration of spring fingers 14 to produce engagement and disengagement of the two sets of teeth 16 and 18 as more fully described relative to FIGS. 3–8.

The first collar 6 has an internal thread 20 for threadedly connecting the coupler to a further body. The body 4 has a circumferential groove 22 to receive the ring 10 while the collar 6 has a groove 24 to receive the same ring. A further circumferential groove 26 is formed in the body 4 immediately to the left of teeth 18 a viewed in FIG. 2.

Figure 3:
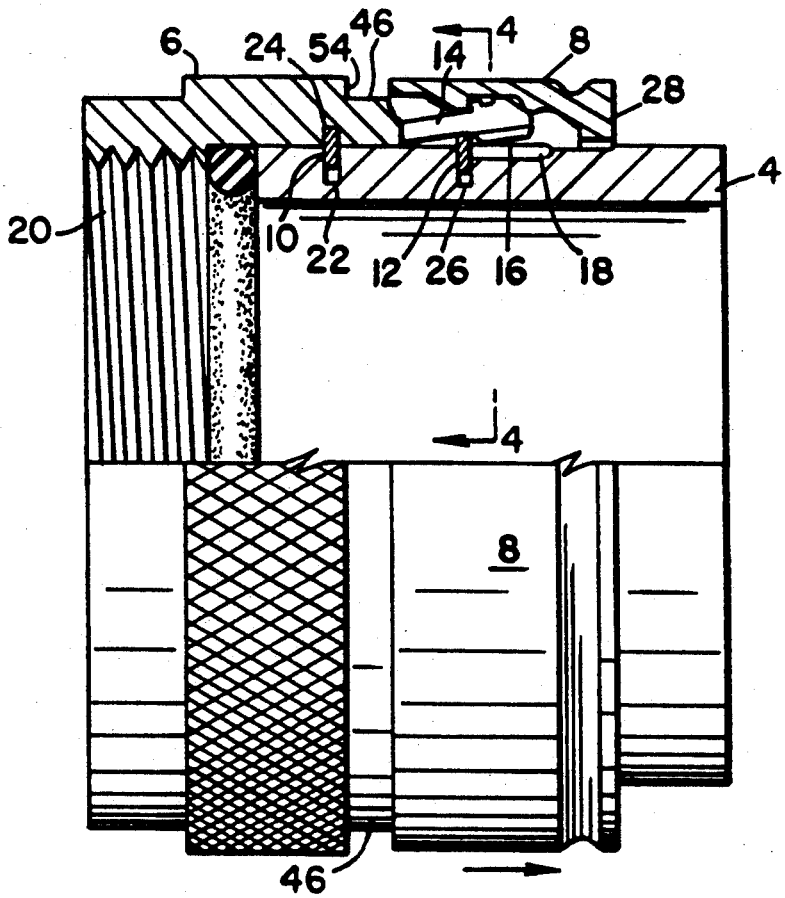
FIG. 3 is a view in longitudinal section partially showing the coupling in the unlocked position.
Figure 4:
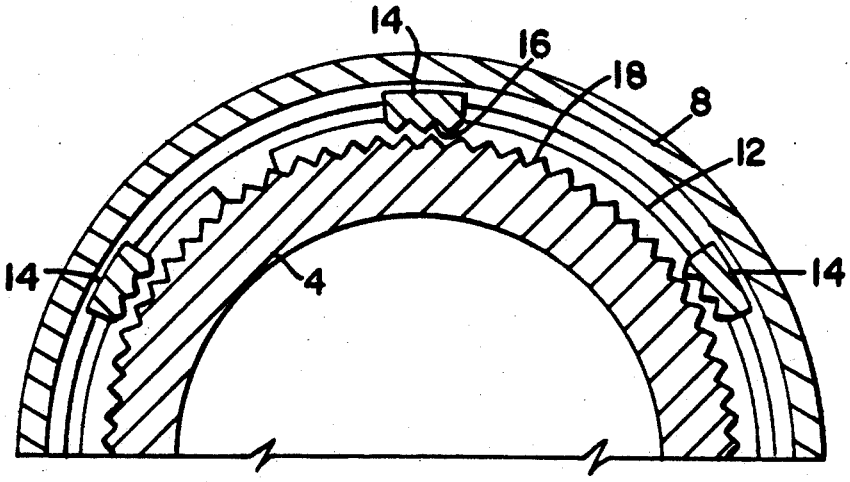
FIG. 4 is a view in cross-section of the coupling in the unlocked position.

Referring now specifically to FIGS. 3 and 4 of the accompanying drawings, the coupler is illustrated in the assembled but unlocked position. The collar 6 overlies the body 4 and is retained thereon by spring ring 10 seated in the grooves 22 and 24 in the body 4 and collar 6, respectively. This collar to body retaining mechanism is just one typical method of retaining these two items.

The spring ring 12 is seated in groove 26 in the body 4 and contacts the inner surface of spring fingers 14 just to the left of the teeth 16 as viewed in FIG. 3. This feature is an option and only provides additional outward radial force to increase the force required to slide the collar 8 axially.

The locking collar 8 has a series of contours comprising an inwardly directed skirt 28 at its right end as viewed in FIGS. 3 and 7 followed from right to left on its internal surface by an outwardly sloping surface 30 that terminates in a inwardly directed projection 32 having an inwardly sloping right edge 34 and a cliff-like outwardly directed left edge 36. A region 38 of constant diameter extends between projection 32 and a radially inwardly directed shoulder 40 of an inwardly directed projection 42. Beyond the projection 42 a wall slopes outwardly and then extends axially to the end of the collar providing a constant diameter surface 44 that slides along a circumferential constant radius surface 46 of the collar 6. By reversing the location of the various contours on the collar 8 and the spring arm 14, the locking and unlocking positions may be reversed. Specifically the protrusion 32 may be moved to the left and a slope corresponding to the slope 52 may be formed on the left side of outer protrusion on the arm. The surfaces 40 and 30 would also be interchanged.

The spring fingers 14, see FIGS. 3 and 8, have an outer surface, opposite the surface with the teeth 16, that has two humps 48 and 50 much like those of a Bactrian Camel terminating at its right end in an inwardly sloping surface 52. In the uncoupled position, as viewed in FIG. 3, the humps 48 and 50 are seated in the region 38 so that the spring fingers are flared outwardly away from the body 4 by their own resistance and also by outward pressure exerted by the spring ring 12.

Upon movement of the collar 8 to the left as viewed in FIGS. 5 and 6 the surfaces 52 of the spring fingers 14 are engaged by the surface 36 of the collar and are forced inwardly so that teeth 16 are forced into engagement with the teeth 18 of the body 4. The projection 32 slides over hump 50 and seats in the space between the humps 48 and 50. The surface 43 prevents overshoot of the collar 8 by engagement with a radial wall 54 terminating the surface 46 of collar 6. The wall 40 of the collar 8 by engaging surface 49 prevents the collar from being moved to the right as viewed in FIGS. 3–6 sufficiently to come off of the collar 6.

If a complete ring of spring fingers 14 is employed, 18 in one embodiment of the invention, right and left unlocking/locking motion of the collar 8 relative to collar 6 is extremely difficult. On the other hand unlocking-/locking motion can be made quite easy with only a few spring fingers; there being some play between the fingers and body sufficient to permit collar 8 to move into the locked position but the spacing is such that the teeth on the fingers are firmly in contact with the teeth on the collar. As indicated, any degree of applied force required to produce locking/unlocking between collars 6 and 8 can be achieved between minimum and maximum force by choice of the number of spring fingers. This feature also increases or decreases the retention on torque force locking the coupling to the body.

Figure 9:
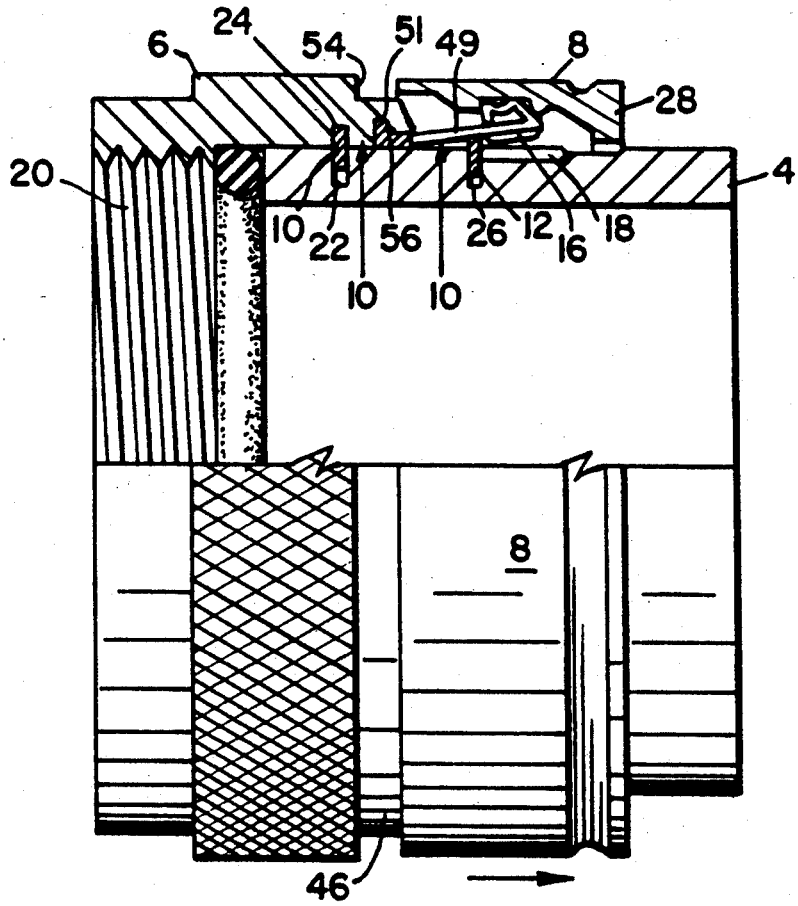
FIG. 9 is a view in partial longitudinal section showing a 2 piece coupling.
Figure 10:
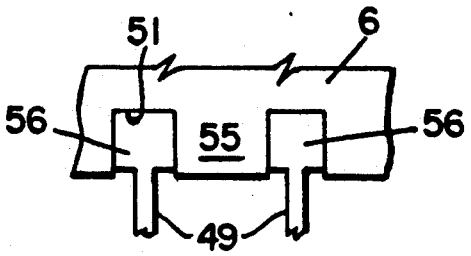
FIG. 10 is a view in cross-section of the 2 piece coupling of FIG. 9 in the unlocked position.
Figure 13:
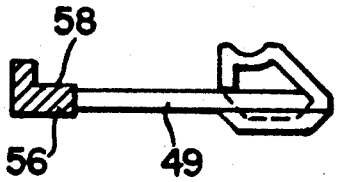
FIG. 13 is a view detailing one example of the contours of the outer surface of the spring fingers, of the 2 piece coupling, where they engage the contoured surface of the locking collar.

Referring now specifically to FIGS. 9, 10 and 13 of the accompanying drawings there is illustrated an embodiment of this invention wherein the spring fingers 49 are carried on a separate ring and are not integral with the collar. Such an embodiment has the advantage of ease of manufacturer and the ability to choose different materials for the collar and the spring fingers.

Specifically, spring fingers 49 are formed on a ring 56 of a circumference less than 360°. The end 58 of the ring remote from the fingers has a radially outward circumferential projection 51 seated in a groove 51 in the collar 6. To permit the ring 56 to be placed on the apparatus and to prevent rotation of the ring 56, the ring 56 is discontinuous at opening 53, see FIG. 10, and the collar 6 has a radially inward projection 55 that is about of the same arc as the opening 53. Thus, the ring may be fitted in the groove 51 but is prevented from rotating relative to collar 6.

Figure 11:
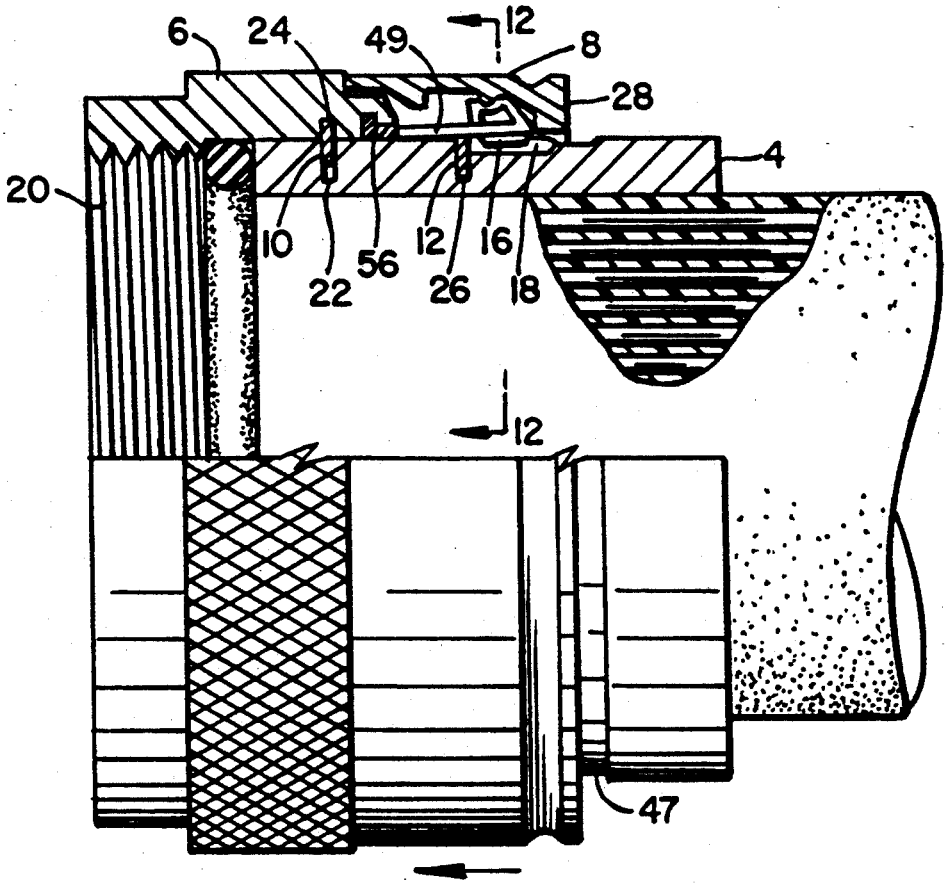
FIG. 11 is a view in partial longitudinal section showing the 2 piece coupling of FIG. 9 in the locked position.
Figure 12:
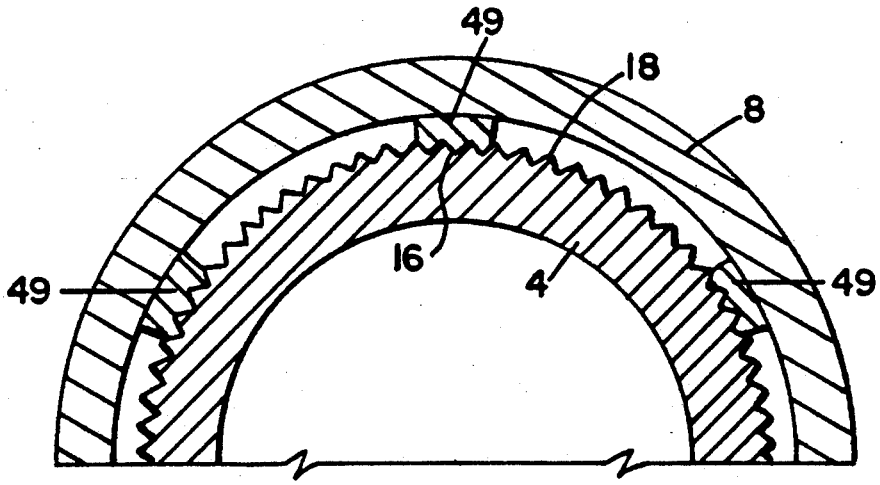
FIG. 12 is a view in cross-section of the 2 piece coupling in the locked position.

The configuration of the radially outward surface of the spring fingers of the embodiment of FIGS. 9 and 13 is different from that of FIG. 8 but the effect is basically the same. The contoured region, however, is hollow being formed of folded spring material; that is, as a continuation of the finger material. The coupling is illustrated in the unlocked position in FIG. 9 and the locked position in FIGS. 11 and 12.

Figure 14:
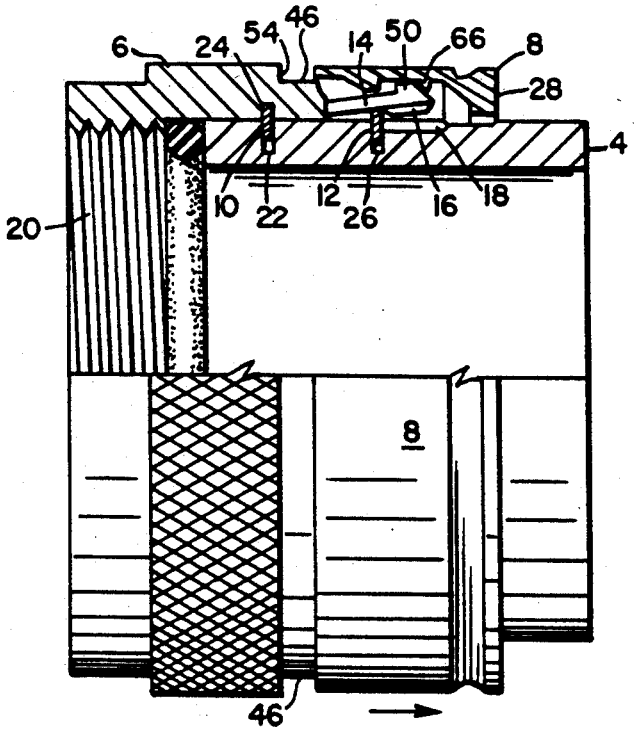
FIGS. 14 through 17 are similar to FIGS. 3 through 8, respectively, with the elements modified so as not to allow disengagement after initial installation.
Figure 15:
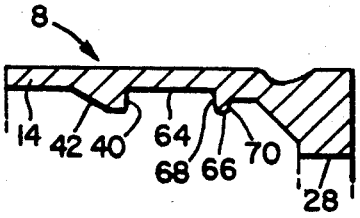
Figure 16:
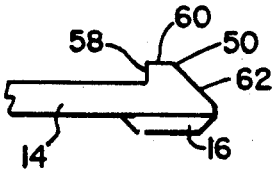

Referring now to FIGS. 14 through 17, there is provided still another embodiment of the present invention wherein once the coupling is locked it cannot be unlocked. In this embodiment of the invention once the locking collar 8 is slid into the locked position it cannot be withdrawn as a result of the configuration of the mating surfaces of the collar 8 and spring fingers 14. The outer surfaces of the ends of the spring fingers as seen in FIGS. 14 and 16 have a vertical face 58 of a radially outward projection 50. The outer circumferential surface 60 of projection 50 is essentially flat and perpendicular to the surface of the face 58. The surface 60 then falls off to a sloping surface 62. The mating surface of the collar 8 is illustrated in FIG. 15. An internal circumferential surface 64 provides a region to receive projection 50 of spring finger 14 in the unlocked position. The surface 64 terminates at its right end as seen in FIGS. 14 and 15, in a radially inward circumferential projection 66 having a sloping surface 68 facing the sloping surface 62 of the spring finger 14. Thus, as the collar 8 is moved toward the left as viewed in FIG. 14, the sloping surfaces 62 and 68 engage and the spring fingers are depressed so that the projection 66 pass over the projection 50 on the spring fingers.

Figure 17:
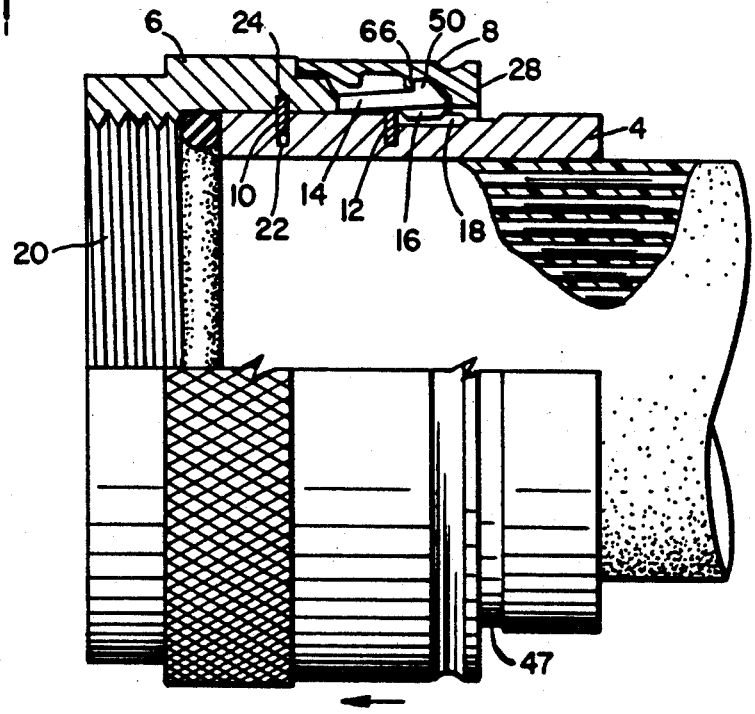

With the elements in such position, this position being illustrated in FIG. 17, the vertical surface 58 of projection 50 is seated adjacent a vertical surface 70 of the member 8. If it is attempted to slide the locking collar 8 to the unlocked position, the vertical surfaces 58 and 70 engage and further movement of the locking collar 8 is prevented. The coupling cannot be unlocked. This feature is considered desirable when the assembly is considered not to be repairable yet requires a spin coupling for installation. Such a situation may arise in molded, potted or encapsulated cables or in any installation where damage is such as to be incapable of or not warrant repair.

It should be noted that the principles of this invention may be employed to lock a coupling against translatory movement by arranging the teeth perpendicular to those illustrated in the accompanying drawings.

Once given the disclosure, many other features, modifications and improvements will become apparent to the skilled artisan. Such other modifications, features and improvements are, therefore, considered a part of this invention, the scope of which is to be determined by the following claims.

We claim:

1. A locking coupling comprising
a body having a plurality of axially extending teeth;
a first collar movably mounted on said body;
a plurality of spring fingers extending axially from said first collar;
said spring fingers having axially extending teeth engageable with said teeth on said body; and
a locking collar mounted on said body for movement between various positions;
said locking collar in one of said positions causing the teeth of said spring fingers to engage the teeth on said body whereby to resist movement of said first collar relative to said body.

2. A locking coupling according to claim 1, wherein visual instructions for use are provided on the coupling.

3. A locking coupling according to claim 1, wherein said one position is with said locking collar in close proximity to said first collar.

4. A locking coupling according to claim 1, wherein said one position is with said locking collar remote from said first collar.

5. A locking coupling according to claim 1, wherein said body is cylindrical.

6. A locking coupling according to claim 5, wherein said first mentioned teeth are arrayed in a circumferential band.

7. A locking coupling according to claim 6, wherein said first collar is coaxial with and rotatable on said body.

8. A locking coupling according to claim 7, wherein said spring fingers extend axially of said body and with its teeth overlying said band of teeth on said body.

9. A locking coupling according to claim 8, further comprising
a ring secured to said first collar;
said spring fingers extending axially from adjacent said ring.

10. A locking coupling according to claim 8, wherein said locking collar is internally configured and said spring fingers are configured on their surfaces remote from said locking collar such that movement of said locking collar into one position move said fingers such that their teeth engage the teeth on said body and in the other position permits said fingers to disengage its teeth from the teeth on said body.

11. A locking coupling according to claim 10, wherein said locking collar is slidable on said body between locked and unlocked positions to lock and unlock said coupling.

12. A locking coupling according to claim 11, wherein visual indicators are applied to said collars to show whether the coupling is in the locked or unlocked position.

13. A locking coupling according to claim 11, further comprising means for predetermining the force required to slide said looking collar between the locked and unlocked position.

14. A locking coupling according to claim 13, wherein said means comprises a spring ring underlying said spring fingers to apply a force to said spring fingers whereby to resist sliding movement of said locking collar.

15. A locking coupling according to claim 14, wherein said means further comprises the number of spring fingers provided.

* * * * *